United States Patent [19]

Hiratsuka et al.

[11] Patent Number: 5,046,437

[45] Date of Patent: Sep. 10, 1991

[54] DEVICE IN A BUTTON SEWING MACHINE FOR MAINTAINING LOOSENESS IN NEEDLE THREAD WHILE PREVENTING THE THREAD FROM BEING PULLED OUT OF THE SEWING NEEDLE

[75] Inventors: Katsuo Hiratsuka, Tochigi; Imao Yazaki; Koichi Nakayama, both of Utsunomiya; Masanori Ayuta, Tochigi, all of Japan

[73] Assignee: SSMC Inc., Edison, N.J.

[21] Appl. No.: 454,582

[22] Filed: Dec. 15, 1989

[30] Foreign Application Priority Data

Jan. 31, 1989 [JP] Japan ..... 1-9354[U]

[51] Int. Cl.[5] ..... D05B 3/14

[52] U.S. Cl. ..... 112/110; 112/112

[58] Field of Search ..... 112/110, 111, 112, 104

[56] References Cited

U.S. PATENT DOCUMENTS

| | | | |
|---|---|---|---|
| 507,507 | 10/1893 | String et al. | 112/112 |
| 659,537 | 10/1900 | Leilich | 112/111 |
| 952,087 | 3/1910 | Trull | 112/112 |
| 1,093,241 | 4/1914 | Barron | 112/110 |
| 2,511,367 | 6/1950 | Nelson | 112/112 |
| 3,509,838 | 5/1970 | Bowin | 112/110 |
| 4,594,953 | 6/1986 | Ando et al. | 112/112 |

OTHER PUBLICATIONS

Model 200-10 button sewing machine, Lewis Sewing Machine Company, Inc.

*Primary Examiner*—Werner H. Schroeder
*Assistant Examiner*—Paul C. Lewis
*Attorney, Agent, or Firm*—Theodore Jay

[57] ABSTRACT

A device for use in a button sewing machine which uses a wire of elastic material for maintaining looseness to that portion of the needle thread between a button and material to which the button is to be sewn while preventing the needle thread from being pulled out of the eye of the needle and at the same time preventing the wire from being warped.

1 Claim, 4 Drawing Sheets

DEVICE IN A BUTTON SEWING MACHINE FOR MAINTAINING LOOSENESS IN NEEDLE THREAD WHILE PREVENTING THE THREAD FROM BEING PULLED OUT OF THE SEWING NEEDLE

BACKGROUND OF THE INVENTION

1. Field of the Invention

The present invention relates to a device in a button sewing machine for maintaining looseness in a needle thread while preventing the thread from being pulled out of the eye of the sewing needle.

2. Prior Art

A known button sewing machine is generally composed of a throat plate having a needle threading hole through which a vertically movable needle passes, a feeding plate mounted on the throat plate on which a material to be sewn is placed, and a button holding unit for holding the button and pressing the material to be sewn wherein the button is sewn on the material while the button holding unit moves rightward, leftward and frontward, rearward.

The button sewing machine of this type is fitted with a device to provide appropriate looseness to the thread between the button and the material as well as to retain this looseness and also prevent the needle thread from being pulled out of the eye of the needle. This button sewing machine has a wire made of elastic material which is interposed between the button and the material to be sewn. However, inasmuch as the wire has a base secured to the side of the feeding plate which is not vertically pivotable, the tip end of the wire interposed between the button and the material to be sewn can be pushed upward and warped when the button holding unit is swung upwardly after the button is sewn on the material. When such warping occurs, the wire is plastically deformed and as a result the position of the warped wire must be changed in order to properly interpose between the button and the material. Such change in position reduces the efficiency of the button sewing operation.

More particularly the button sewing machine incorporated a specific mechanism for providing appropriate relative movement after completion of the sewing operation between the wire, button and the material to be sewn, and this mechanism increased the cost and complexity of the machine.

SUMMARY OF THE INVENTION

It is therefore an object of the present invention to provide a device for use in a button sewing machine utilizing a wire of elastic material which prevents the wire from being warped while at the same time prevents the needle thread from being pulled out of the eye of the sewing needle.

It is another object of the present invention to provide appropriate looseness and prevent the needle thread from being pulled out of the eye of the needle while preventing warpage of a wire of elastic material.

To achieve the above objects, a device for use in a button sewing machine for keeping loose and preventing the needle thread from being pulled out of the eye of the needle while preventing warpage of a wire of elastic material utilizes a throat plate fixed to a bed of a sewing machine. The throat plate has a needle threading hole and a projection at the periphery of the needle threading hole. A feeding plate is mounted on the bed for moving material to be sewn which is placed along the surface of the throat plate. The feeding plate has an opening for receiving the projection. A button clamping arm is pivotably supported by the feeding plate and has button holding arms for holding a button. The wire made of elastic material has a base end secured to the button clamping arm and a tip end held by the button holding arms. The wire is positioned under the button. The button is pressed toward the projection of the throat plate via the wire and the material to be sewn when the button clamping arm is swingably lowered.

The above and other objects, features and advantages of the present invention will become more apparent from the following description taken in conjunction with the accompanying drawings.

DESCRIPTION OF THE PREFERRED EMBODIMENT

Figure 1:
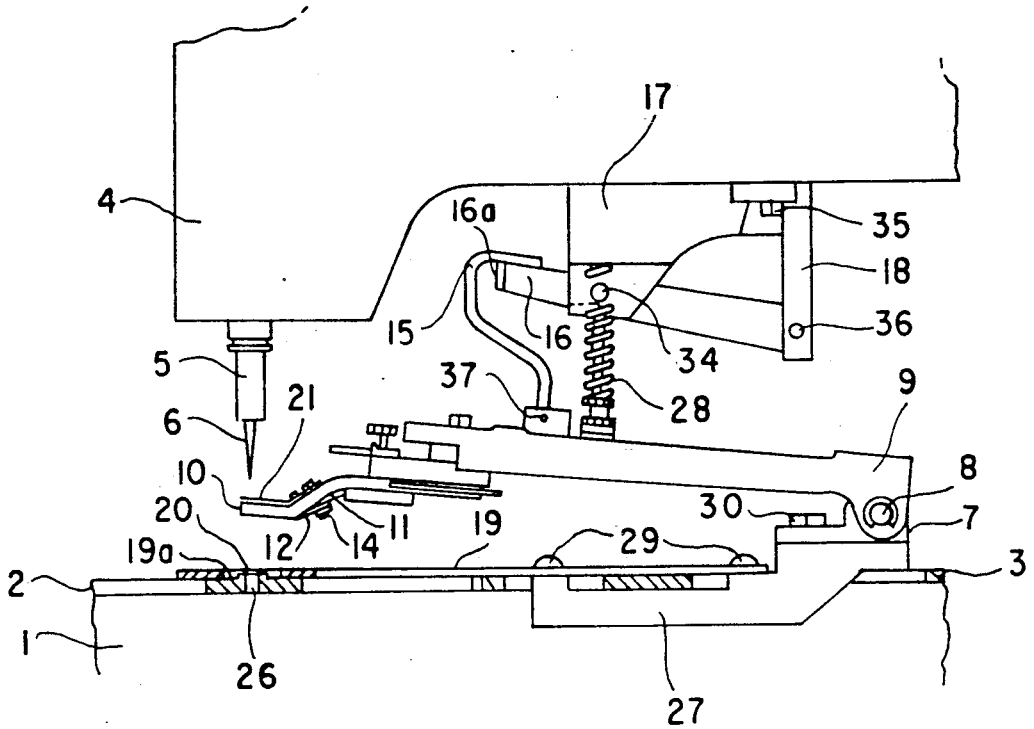
FIG. 1 is a front elevation view of a preferred embodiment of the invention.

Referring now to FIGS. 1-8, a throat plate 2 is secured to a bed 1 of a sewing machine. The throat plate 2 has a needle threading hole 26 and a projection 20 at the periphery of the needle threading hole 26. A feeding plate 19 is mounted on the bed 1 for moving a material to be sewn and placed thereon along the surface of the throat plate 2. The feeding plate 19 has an opening 19*a* for receiving the projection 20. A button clamping arm 9 is pivotally supported at one end by the feeding plate 19 and has button holding arms 10, 11 at the free and opposite end thereof for holding a button 22. A wire 12 made of elastic material has a base end secured to the button clamping arm 9 and a tip end held by the button holding arms 10, 11. Wire 12 is positioned under the button 22. Button 22 is pressed toward the projection 20 of the throat plate 2 via the wire 12 and the material to be sewn.

Arm 4 as well as the throat plate 2 and a cover plate 3 are attached to the bed 1. Supported on the arm 4 is a needle bar 5 which is vertically movable and interlocking with a main shaft (not shown) of the button sewing machine and secures a needle 6. The throat plate 2 has the needle threading hole 26 through which the needle 6 passes and the upwardly projected projection 20 is formed at the periphery of the needle threading hole 26.

Figure 3:
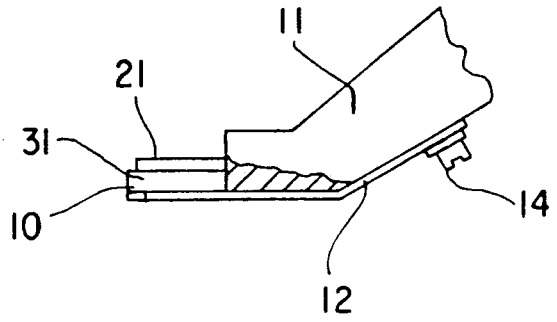
FIG. 3 is an enlarged front elevation of a portion of the embodiment shown in FIG. 1.
Figure 4:
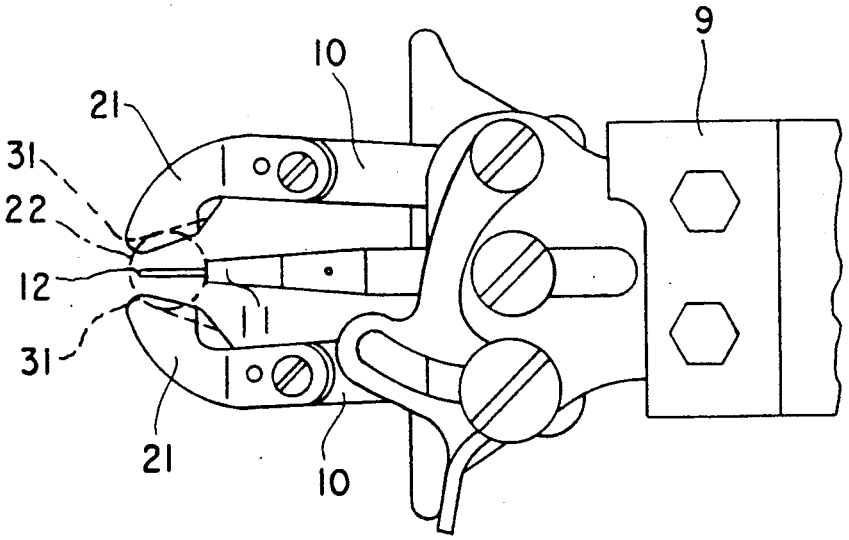
FIG. 4 is an enlarged plan view of the structure shown in FIG. 3.

A feeding table 27 is supported on the bed 1 and is movable rightward, leftward, and forward, rearward by a feeding cam (not shown) along the surface of the throat plate 2. The feeding plate 19 is fixed to the upper surface of the feeding table 27 by a screw 29 and has the opening 19*a* located over the needle threading hole 26. This hole is positioned and is so sized as not to interfere with the hole of the button 22 (described later) and the projection 20 of the throat plate 2. The feeding table 27 has a base end to which a button clamping arm bracket 7 is fixed by a bolt 30. The clamping arm 9 extending toward the needle bar 5 is pivotably mounted at the base end thereof on the button clamping arm bracket 7 by a supporting shaft 8 so as to be vertically swung. Both of first button holding arms 10 having openable tip ends are attached at the base ends thereof to the tip end of the button clamping arm 9 as shown in FIG. 4. The second button holding arm 11 is secured to a lower surface located between the first button holding arms 10. Holding plates 21, 21 slightly protruding from and opposed to the first button holding arms 10 are fixed to the first button holding arms 10 to thereby define a pair of button holding members 31, 31 as shown in FIG. 3. The wire 12 made of elastic material such as spring material has a base end fixed to the tip end of the second button holding arm 11 and a tip end extending under and between the pair of button holding members 31, 31.

The arm 4 has a pedal lifter fitting lever bracket 17 screwed by a clamping bolt 35. A presser bar spring 28 is interposed between the pedal lifter bracket 17 and the button clamping arm 9 and always urges the lower surfaces of the first button holding arms 10 and the tip end of the wire 12 toward the feeding plate 19 so that the lower surfaces of the first button holding arms 10 and the tip end of the wire 12 are pressed against the portion adjacent to the opening 19*a* of the feeding plate 19. A pedal lifter fitting lever 16 is pivotally mounted at the middle portion thereof on the pedal lifter fitting lever bracket 17 by a pin 34. The pedal lifter fitting lever 16 is swingably connected at one end thereof to a pressure bar lifter operating shaft 18 by a pin 36 which is vertically driven by operating a pedal (not shown) and holds a button clamping arm hook 15 at the other end thereof. The button clamping arm hook 15 is secured to a middle portion of the button clamping arm 9 by a screw 37.

Figure 2:
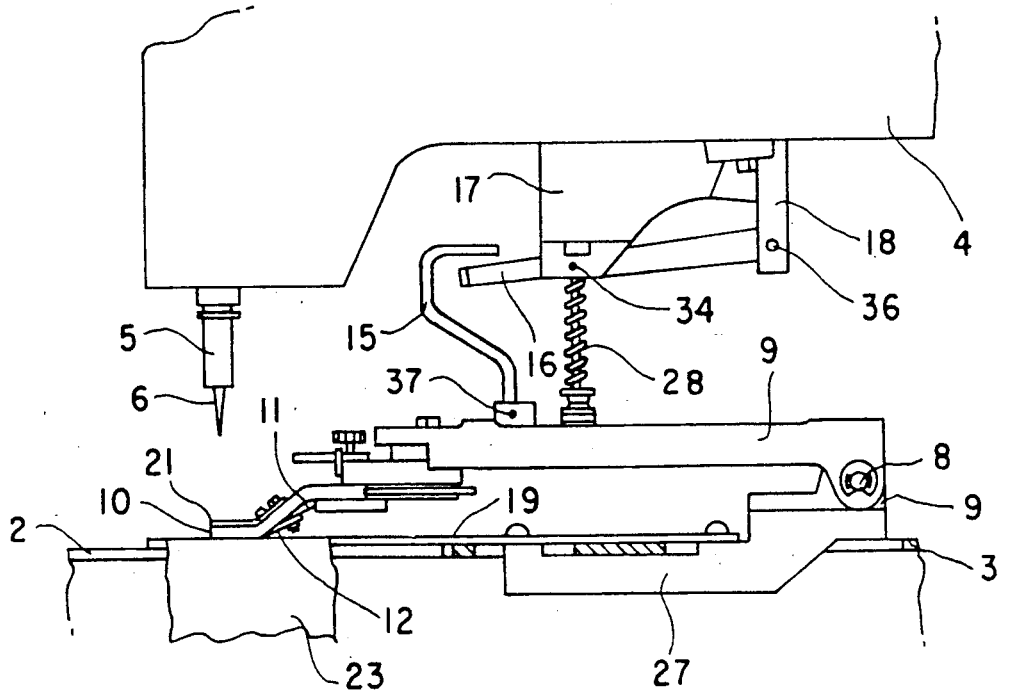
FIG. 2 is a view illustrating an operation of the embodiment of FIG. 1.

As the pressure bar lifter operating shaft 18 is lowered by a pressure bar lifter device (not shown) as shown in FIG. 1, the other end 16*a* of the pedal lifter fitting lever 16 is raised to thereby lift the button clamping arm 9 via the button clamping arm hook 15 so that the button clamping arm 9 is upwardly swung about the supporting shaft 8 against the resilient force of the presser bar spring 28. As the pressure bar lifter operating shaft 18 is lifted as shown in FIG. 2, the button clamping arm 9 acted upon by the resilient force of the presser bar spring 28 is swung downwardly.

Before the sewing operation is started, the pressure bar lifter operating shaft 18 is lowered by the pressure bar lifter device so that the first button holding arms 10 and the second button holding arm 11 are raised. With actuation of the first button holding arms 10, the button 22 is held by the pair of button holding members 31, 31. At this state, the tip end of the wire 12 is positioned centrally under the lower surface of the button 22.

Successively, the material to be sewn 23 is placed on the feeding plate 19 and the pedal is pressed at its first step for thereby driving the pressure bar lifter operating shaft 18 to be lifted by the pressure bar lifter device. At this state, the pressure bar lifter operating shaft 18 is raised as shown in FIG. 2 whereby the first button holding arms 10 and the second button holding arm 11 are lowered with swinging motion of the button clamping arm 9 under the force of the presser bar spring 28. The material to be sewn 23 is clamped by the lower surfaces of the first button holding arms 10 at the periphery of the opening 19*a* of the feeding plate 19 and is clamped on the upper surface of the projection 20 of the throat plate 2 by the tip end of the wire 12.

Figure 5:
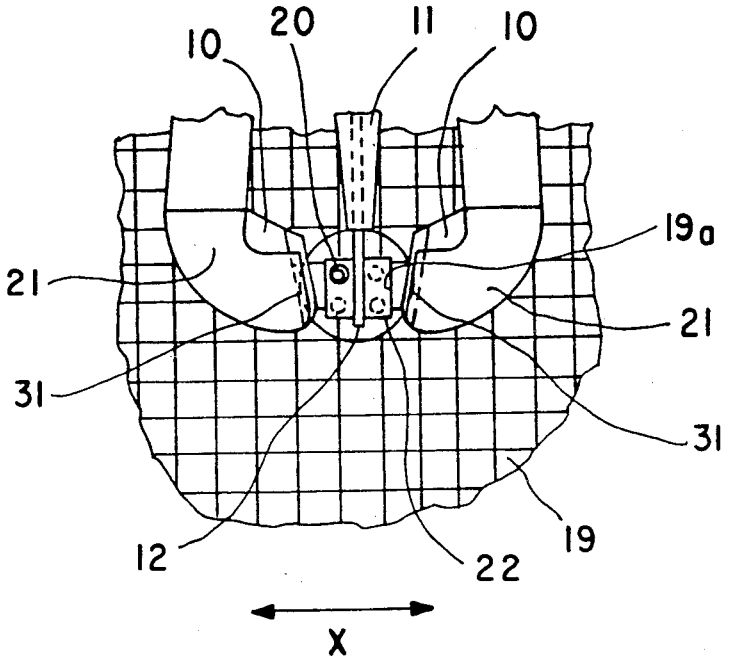
FIG. 5 is a plan view showing the positions of the wire and first button clamping arms just before starting of the sewing operation.
Figure 6:
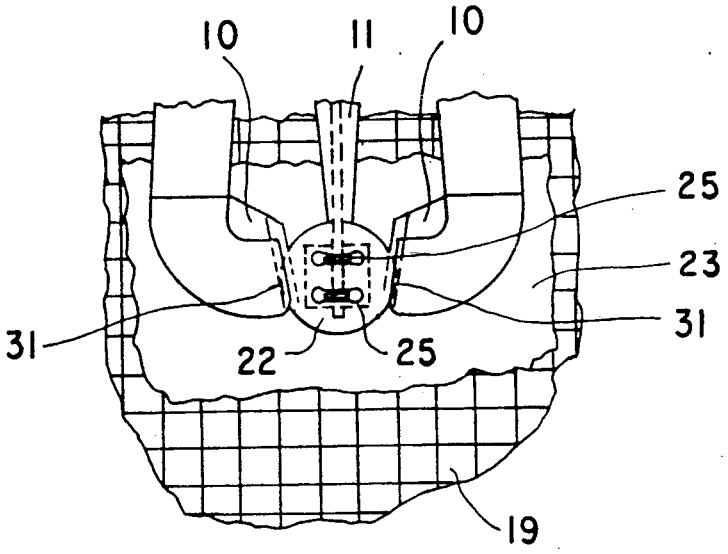
FIG. 6 is a plan view showing the positions of the wire and the first button holding arms just after completion of the sewing operation.
Figure 7:
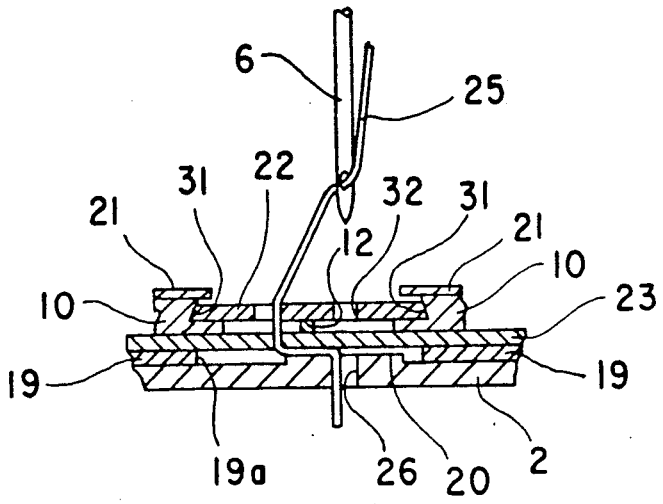
FIGS. 7 and 8 are respectively views illustrating operations of the wire and button clamping arms as shown in FIGS. 5 and 6.
Figure 8:
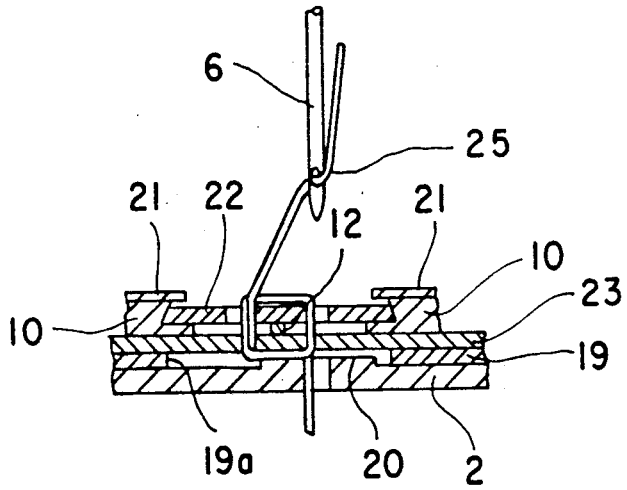

Further pressing of the pedal at its second step causes button sewing machine to be actuated. The parts relative to the device for feeding the material to be sewn such as the feeding plate 19, the first button holding arms 10, the second button holding arm 11, etc. are moved leftward as shown in FIG. 5 after the needle is lowered in a first stitch but before the needle is lowered in a second stitch as shown in FIG. 7 whereby the other hole of the button 22 is positioned on the passage line of the needle 6. At this point, the wire 12 moved together with the feeding plate 19 crosses the needle threading hole 26 so that the wire 12 clamps the lower end of the needle thread 25 to the upper surface of the projection 20 of the throat plate 2 while interposing the material to be sewn therebetween. As a result, it is possible to prevent the needle thread from being extracted from the material to be sewn when the needle bar is lifted.

In such a manner, the sewing operation of the second stitch and the stitches following the second stitch progress while the wire 12 is interposed between the button 22 and the material to be sewn whereby a predetermined looseness is imparted to the sewing thread.

After completion of the sewing operation of the last stitches, the needle thread and the bobbin thread are cut off by a thread cutting device (not shown) then the button clamping arm 9 is swung upwardly whereby the first button holding arms 10 and the second button holding arm 11 are returned to be positioned in the upward position. At this time, the wire 12 attached to the second button holding arm 11 is lifted as a whole together with the material to be sewn 23 on which the button 22 is sewn whereby the wire will not warp. Thereafter, the pair of first button holding arms 10 are opened to release the hold of the button 22 to draw the material to be sewn 23. The button sewing operation is thus completed.

According to the embodiment set forth above, the wire 12 is attached to the second holding arm 11 but may be attached to the member swingable together with the button clamping arm 9 to attain the same effect.

As understood from the above explanation, inasmuch as the wire is capable of moving upward together with the button and the material to be sewn after completion of the sewing operation, so that the wire is prevented from being warped and the desired looseness can be retained in a stable manner while the upper thread will not be pulled out of the eye of the needle, reliability and durability of the button sewing machine is substantially improved.

Although the invention has been described in its preferred form with a certain degree of particularity, it is to be understood that many variations and changes are possible in the invention without departing from the scope thereof.

What is claimed is:

1. A device for use in a button sewing machine for sewing a button on material, said button having two opposite surfaces, and having a bed for maintaining looseness in a needle thread while preventing the thread from being pulled out of an eye of a needle, said device comprising:

a throat plate fixed to said bed, the throat plate having a needle threading hole and a projection at the periphery of the needle threading hole;

a feeding plate mounted on the bed for moving said material placed thereon along a surface of the throat plate, the feeding plate having an opening for receiving the projection;

a button clamping arm swingably supported at one end by the feeding plate and having a free end;

a pair of button holding arms secured to the free end of the button clamping arm for holding the button; and a wire made of elastic material having a base end fixed to the button clamping arm and a tip end held by the button holding arms, the wire being positioned under one surface of the button; the button, the wire, and the material being pressed toward the projection of the throat plate by the button holding arms.

* * * * *